United States Patent [19]

Naegeli

[11] 4,026,484

[45] * May 31, 1977

[54] APPARATUS FOR CONTROLLING A WINDING DEVICE FOR A CONTINUOUSLY SUPPLIED FIBER SLIVER

[75] Inventor: Werner Naegeli, Winterthur, Switzerland

[73] Assignee: Pavena AG, Basel, Switzerland

[ * ] Notice: The portion of the term of this patent subsequent to June 24, 1992, has been disclaimed.

[22] Filed: Feb. 3, 1975

[21] Appl. No.: 546,551

Related U.S. Application Data

[63] Continuation of Ser. No. 262,028, June 12, 1972, Pat. No. 3,891,155.

[30] Foreign Application Priority Data

June 19, 1971 Switzerland ..... 9003/71

[52] U.S. Cl. ..... 242/45; 242/47.01; 242/47.12; 242/47.13

[51] Int. Cl.[2] ..... B65H 59/38

[58] Field of Search ..... 242/45, 47.01, 47.12, 242/47.13, 75.5, 75.51, 75.52, 75.3, 75.53, 86.5 R

[56] References Cited

UNITED STATES PATENTS

| | | | |
|---|---|---|---|
| 1,851,252 | 3/1932 | Junkers | 242/47.13 |
| 2,741,437 | 4/1956 | Haworth | 242/45 |
| 2,755,916 | 7/1956 | McIlvried et al. | 242/47.12 |
| 2,824,616 | 2/1958 | Knight et al. | 242/86.5 R X |
| 3,051,362 | 8/1962 | Shook | 242/45 X |
| 3,078,055 | 2/1963 | Harris | 242/47.12 |
| 3,099,412 | 7/1963 | Nystrom | 242/47.01 |
| 3,131,729 | 5/1964 | Leysinger | 242/47.13 X |
| 3,480,218 | 11/1969 | Lawson | 242/45 |
| 3,891,155 | 6/1975 | Naegeli | 242/45 |

*Primary Examiner*—Stanley N. Gilreath
*Attorney, Agent, or Firm*—Werner W. Kleeman

[57] ABSTRACT

Apparatus for controlling the winding of a continuously supplied fiber sliver on a bobbin which comprises a winding device for winding the continuously supplied fiber sliver from a supplying device on the bobbin arranged on said winding device and means for interrupting the winding phase of the winding device by a standstill phase during a bobbin change. A storage device is provided having a guiding means for building-up a fiber sliver reserve, and said guiding means being arranged at least translatorily movably over a distance for building-up the fiber sliver reserve during the standstill phase and for reducing the fiber sliver reserve during the winding phase. The guiding means is operatively connected with means for moving the guiding means to build-up the fiber sliver reserve and for tensioning the fiber sliver during the winding and the standstill phase. Means are provided for electrically controlling a drive motor of the winding device and which are connected with said guiding means and said winding device and arranged to be operated by movement of the guiding means.

9 Claims, 21 Drawing Figures

APPARATUS FOR CONTROLLING A WINDING DEVICE FOR A CONTINUOUSLY SUPPLIED FIBER SLIVER

CROSS-REFERENCE TO RELATED CASE

The present application is a continuation of my commonly assigned, copending application Ser. No. 262,028, filed June 12, 1972, now U.S. Pat. No. 3,891,155 granted June 24, 1975.

BACKGROUND OF THE INVENTION

The present invention relates to a new and improved apparatus for controlling a winding device for a continuously supplied fiber sliver and which can be stopped or shut-down during the bobbin change operation.

With continuously supplied fiber slivers which are wound onto a bobbin by a winding device the necessity arises of effecting a bobbin change operation from time to time for exchanging a filled bobbin against an empty tube. This operation can be effected in different manner, depending upon the type of winding device employed. A suitable winding device is one provided with more than one winding spindle per winding head, for example a so-called revolver or turret head; another suitable winding device is one provided with one single winding spindle per winding head.

If there is used a known winding device provided with more than one winding device per winding head, the possibility exists of carrying out a so-called flying bobbin change, i.e. the winding process is not interrupted. In this case if the full diameter of the bobbin is reached, the winding spindle which is in its operating position is moved, and simultaneously a second winding spindle prepared with an empty tube is brought into operating position. This movement of two winding spindles, which in the case of a revolver head constitutes a rotary movement, can be carried out very quickly. Transfer of the fiber sliver from the full bobbin to the empty tube and tearing or breaking of the sliver connecting the two also must be effected very quickly if no interruption of the winding process is desired. The use of a winding device of this type, however, involves serious disadvantages in the winding of a continuously supplied fiber sliver.

A first disadvantage of a multi-spindle type winding device resides in the fact that it is complicated and expensive. A plurality of winding spindles is needed and the winding device must be additionally equipped with a complicated control mechanism so that each winding spindle, the position of which must be movable, can be driven while it is in its operating position.

A further disadvantage of the known multi-spindle winding device is, notwithstanding the theoretical possibility of effecting a bobbin change operation without interruption of the winding process, also here the necessity arises of providing control elements for the speed of the winding device or at least for the winding tension, since it is extremely difficult to achieve perfect synchronization of the speeds of the continuously supplied fiber sliver and the winding device and furthermore variation of the fiber sliver tension is unavoidable during the bobbin change. For this reason, there has been proposed the use of a so-called dancer or tensioning roll arranged between the last element continuously supplying the fiber sliver and the winding device, i.e. a roll permitting adaption of the fiber sliver path length within a limited range. By reciprocating the dancer roll it was possible to realize a compensation of the winding tension of the fiber sliver and/or an adaption of the winding speed of the winding device.

The application of multiple-spindle winding devices for flying bobbin change is also not possible with all types of fiber slivers due to the very short time periods available for severing the fiber sliver, e.g. difficulties prevail when severing fiber slivers of very high breaking strength, such as e.g. thick slivers of staple fibers bonded by adhesive or endless filaments at such installations.

SUMMARY OF THE INVENTION

It is thus a goal of the inventive apparatus for implementing same to eliminate the above-mentioned disadvantages and to propose an apparatus permitting in simple manner the application of a single-spindle winding device for winding a continuously supplied fiber sliver. In so doing, the following mutually independent objectives are to be technologically achieved:

a. The winding process is to be interrupted during bobbin change over a sufficiently long time span.

b. The winding tension, i.e. the tension under which the sliver is wound onto the winding bobbin, is to be precisely controlled during the entire winding process, including the time-span encompassing interruption of winding.

The inventive apparatus furthermore has an objective permitting control of a winding device of the precision winding type in which the bobbin shaft or axle is driven as well as a friction drum winding device in which the bobbin is driven by friction drum winding device in which the bobbin is driven by surface friction.

The disadvantages mentioned above are eliminated and the above-mentioned objects are achieved by means of the proposed method of controlling a winding device for a continuously supplied fiber sliver, in which the winding phase is interrupted by a standstill phase during bobbin change, and which is manifested by the features that:

a. the winding tension in the fiber sliver during the winding phase is controlled as a function of the bobbin diameter, b. the tension in the fiber sliver is controlled during the standstill phase, c. a fiber sliver reserve is built-up during the standstill phase, d. during the winding phase the fiber sliver reserve built-up during the preceding standstill phase is reduced, and e. during the winding phase the rotational speed of the winding device is controlled as a function of the reduction of the fiber sliver reserve.

According to a specific embodiment of the inventive method there prevails at all times a functional connection in the form of a coupling between the winding tension, the length of the fiber sliver reserve and the rotational speed of the winding device.

The method can be used both with winding devices of the precision winding type and with winding devices of the friction drive drum type.

The inventive apparatus for implementing the aforedescribed method with a winding device for winding a continuously supplied fiber sliver which is stopped during a bobbin change, is manifested by the features that between a last element continuously supplying the fiber sliver and the winding device there are provided means performing the following functions:

a. control of the winding tension in the fiber sliver during the winding phase as a function of the bobbin diameter, b. control of the tension in the fiber sliver during the standstill phase, c. build-up of a fiber sliver reserve during the standstill phase, d. reduction of the fiber sliver reserve during the winding phase, and e. control of the rotational speed of the winding device during the winding phase as a function of the reduction of the fiber sliver reserve.

According to a specific embodiment of the inventive apparatus a functional relationship in the form of a coupling exists at all times between the means carrying out the above-mentioned functions (*a*) through (*e*).

The winding device can be both a winding device of the precision winding type in which the bobbin axis is driven as well as a friction drum drive type winding device in which the bobbin surface is driven by friction.

According to one preferred construction there is provided apparatus for controlling the winding of a continuously supplied fiber sliver on a bobbin which comprises:

a. a winding device for winding said continuously supplied fiber sliver from a supplying device on the bobbin arranged on said winding device;

b. means for interrupting the winding phase of the winding device by a standstill phase during a bobbin change;

c. a storage drum including guiding means for building-up a fiber sliver reserve, said drum being arranged in the path of said fiber sliver between said supplying device and said winding device for receiving the fiber sliver supplied with a continuous speed to said storage drum, said drum having a surface on which the fiber sliver is helically wound, and means for transporting the helically wound fiber sliver at the surface of the drum in the longitudinal direction of such drum;

d. said guiding means being arranged downstream of said storage drum between the supplying device and the winding device, said guiding means being arranged at least translatorily movably over a distance for building-up the fiber sliver reserve during the standstill phase and for reducing the fiber sliver reserve during the winding phase, said guiding means being operatively connected with means for moving the guiding means to build-up the fiber sliver reserve and for tensioning the fiber sliver during the winding and the standstill phase; and e. means for electrically controlling a drive motor of the winding device, said means for electrically controlling the drive motor being connected with said guiding means and said winding device, said means for electrically controlling the drive motor being arranged to be operated by movement of said guiding means.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
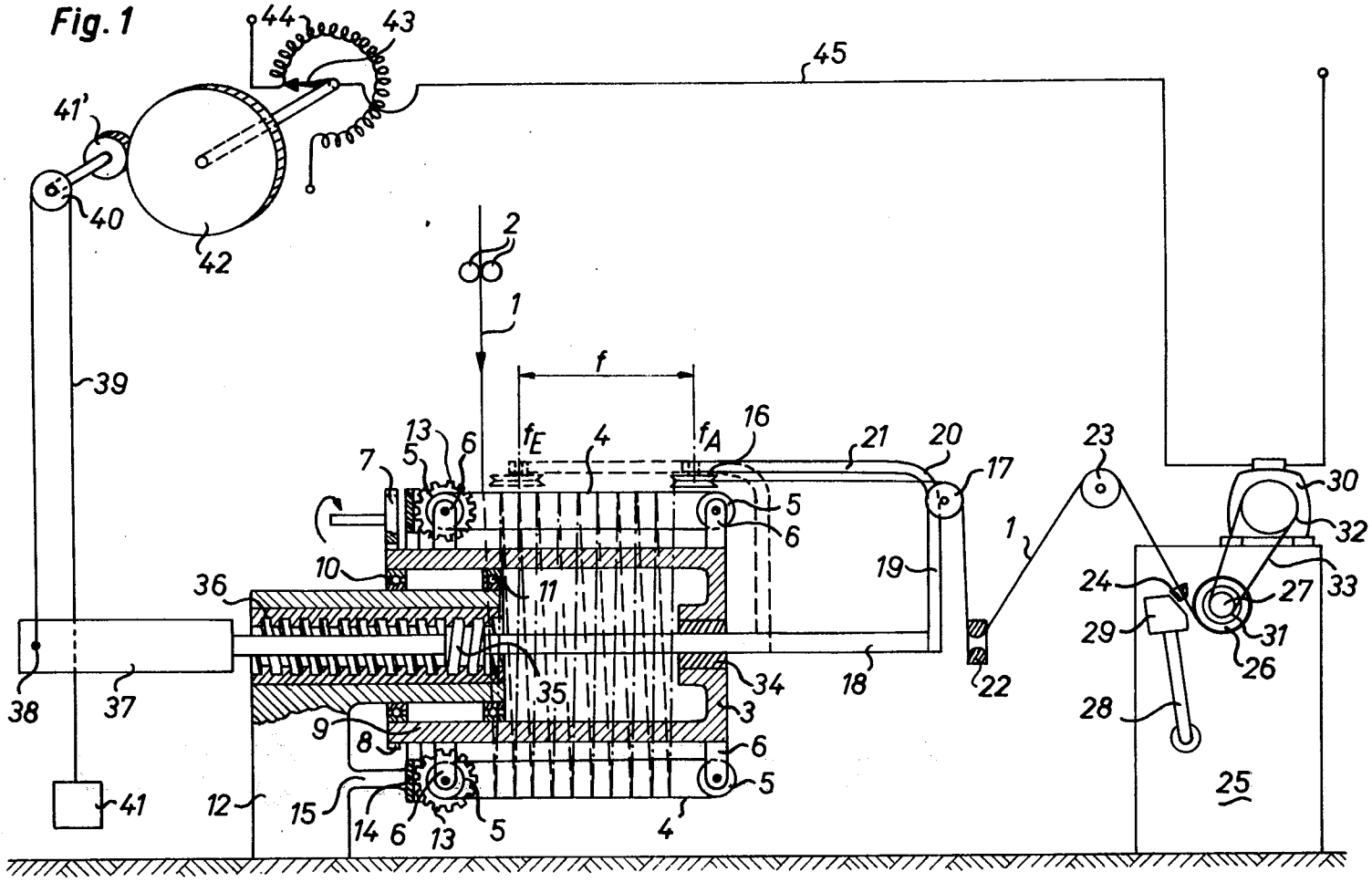
FIG. 1 is a side view and partially in section of the inventive apparatus with a winding device of the precision winding type, the apparatus being shown shortly after the bobbin change.
Figure 2:
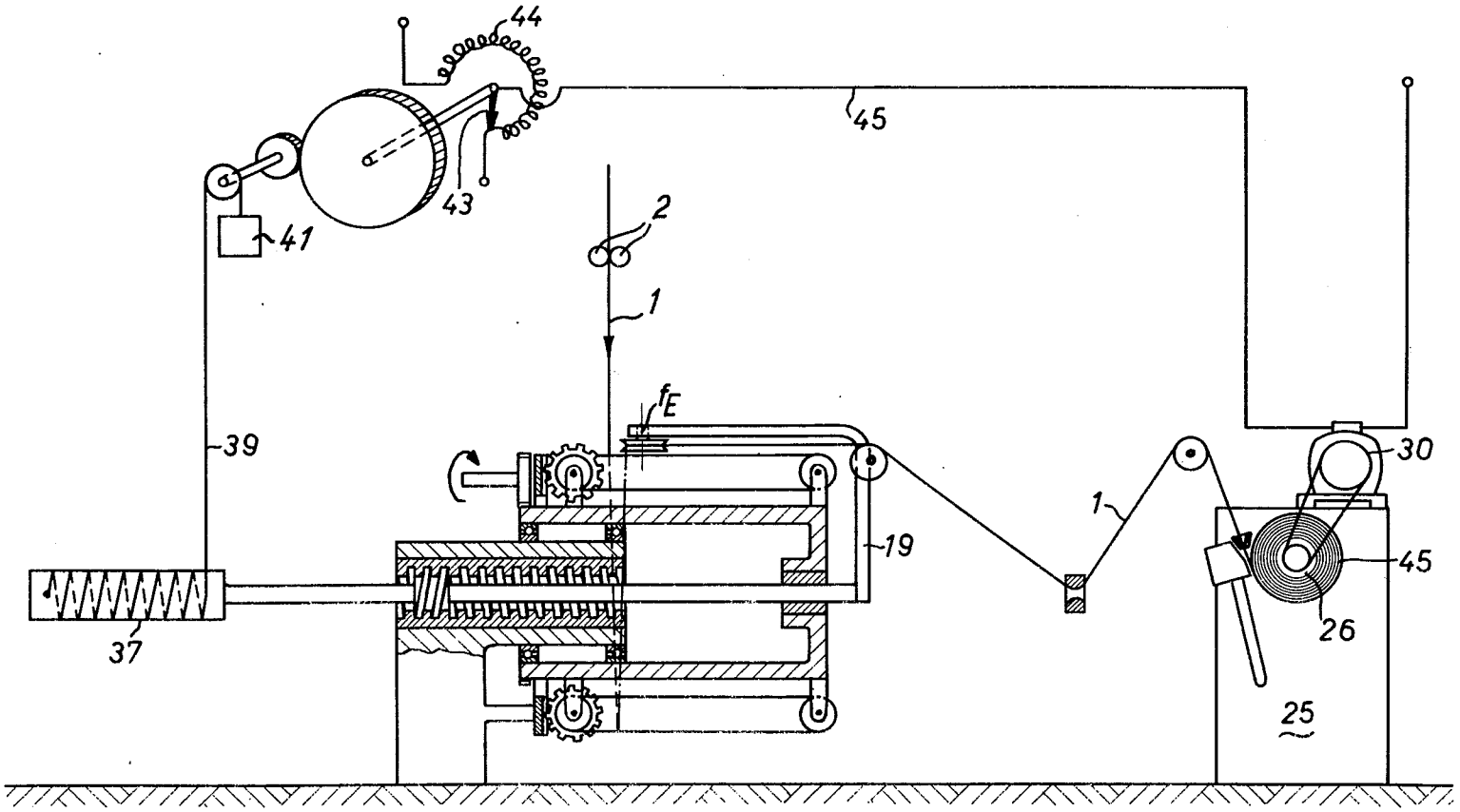
FIG. 2 is the same view of the apparatus according to FIG. 1, but shown shortly before the bobbin change.

Describing now the drawings, and considering initially the exemplary embodiment of inventive apparatus as depicted in FIGS. 1 and 2, it will be understood that a continuously supplied sliver fiber 1 delivered by feed rolls 2 is tangentially wound onto the surface of a storage drum 3 owing to the rotation of the latter. The details of the storage drum 3 will be considered to the extent necessary for providing a clear and complete understanding of the subject matter of this development. However, it is to be mentioned that storage drum 3 may be of the type described in my commonly assigned U.S. application, Ser. No. 262,029, filed June 12, 1972, and entitled "Apparatus For Continuous Treatment of a Fiber Assembly Or Strand Consisting of Staple Fibers or Endless Filaments" to which reference may be readily had. As explained in considerable detail in the aforementioned application this storage drum 3 may substantially consist of a large number of transporting belt runs or legs 4 forming a surface, the cross-section of which defines a many-sided polygon, that is, is approximately circular, and further comprises belt guide rolls 5 and supports 6 for the belt guide rolls 5.

The transporting belt runs or legs 4 are part of one or a plurality of transporting belts running on the belt guide rolls 5. The transporting belt runs 4 forming the drum surface move at the same speed and in the same direction from the left to the right on the rotating drum surface. On the drum surface there is thus formed a fiber sliver helix moving from the left to the right, the helix angle of the fiber sliver helix being determined by the ratio of the rotational speed of the drum 3 and the lengthwise movement of the transporting belt runs or legs 4. The rotation of the drum 3, according to FIG. 1 is effected, for instance, by means of a driven gear 7 and a gear 8 meshing therewith, gear 8 being directly connected to the cylindrical extension 9 of the drum 3. The rotating drum 3 is supported by a stationary support frame 12 in two bearings 10 and 11.

The lengthwise movement of the transporting belt runs or legs 4 according to the embodiment of FIG. 1 is effected for example in that each belt guide roll 5 at the left-hand drum side is directly connected with a worm gear 13 placed on the same shaft or axle. All worm gears 13 mesh with a stationary worm 14 coaxially arranged with respect to the drum axis at the drum end face and by means of a connecting member 15 is rigidly connected with the support frame 12. Instead of the here exemplary illustrated solution for the rotational drive of the drum and the lengthwise drive of the transporting belts any other suitable drive arrangement also can be used. The rotating drum designed as above-described forms a fiber sliver storage of the apparatus.

After passing the surface of the drum 3 the fiber sliver 1 is lifted-off the drum surface by a roll 16, the axis of which is arranged at right angles to the drum surface and is deflected in the direction of a further deflecting roll 17. Instead of using such deflecting rolls 16 and 17 stationary guide elements, such as for example eyelets or trumpets, can be of course also used. The rolls 16 and 17 are rotatably supported on flyer 19 which is rigidly connected with a shaft 18, the shafts or axles of rolls 16 and 17 being mutually arranged at approximately right angles with respect to one another. The flyer 19 consists of a light tube or stiff profile forming a right-angle at the point 20, the horizontal arm 21 of the flyer 19 being of such length that the roll 16 can be moved axially in a manner to be described in more detail hereinafter from its position $f_A$ shown in FIG. 1 with solid lines to its position $f_E$ shown in FIG. 1 with broken or phantom lines and also shown in FIG. 2 with solid lines. The distance between the flyer positions $f_A$ and $f_E$, designated by reference character $f$, corresponds to the storage capacity or to the fiber sliver reserve respectively, of the drum 3.

After passing around the deflecting roll 17 the fiber sliver passes through a stationary guide element 22 (e.g. an eyelet) arranged coaxially with respect to the shaft 18 and from there is transferred to a stationary deflecting roll 23. From the deflecting roll 23 the fiber sliver is directly transferred towards a to and fro traversing thread guide 24 of a conventional winding device 25 of a precision winder. Such winding device 25 substantially consists of a winding spindle 27 onto which is placed a tube 26, the traversing thread guide 24 with a traversing mechanism 29 (only indicated schematically) mounted on a pivotable frame 28, and a drive motor 30 driving the winding spindle 27 and the traversing mechanism 29. The winding spindle 27 shown in FIG. 1 is driven by the drive motor 30 via a belt embodying pulleys 31 and 32 and belt 33. The nature of such drive is not crucial, but it is important that in the winding device of the precision winding type the winding spindle 27 is directly driven by the drive motor 30. In this arrangement the rotational speed of the winding spindle 27 is referred to as winding speed.

The shaft 18 is rotatably supported by means of a bearing 34 at the drum 3 and behind this bearing 34 such is provided with the threaded portion 35. This threaded portion 35 can be screwed in and out of a nut 36 stationarily arranged in the support frame 12 during such time as the flyer 19 with the shaft 18 rotates. The thread pitch of the threaded portion 35 exactly corresponds to the pitch of the fiber sliver helix coils on the drum surface. The length of the nut 36 is chosen at least such that the flyer 19, by screwing, the threaded portion 35 into the nut 36, can move axially from the right-hand position $f_A$ to the left-hand position $f_E$. The roll 16, thus during its movement, follows a helix of the same pitch as of the helix of the fiber sliver 1 on the drum surface. At the other end of the shaft 18 there is fixed for rotation therewith a member 37 of round cross-section, which member 37 in the embodiment of FIG. 1 is for instance of cylindrical form. At a point 38 of the member 37 close to the extreme end opposite the flyer 19 there is tangentially mounted a flexible string 39. This string or cable 39 passes around a roll 40 and at its other end is loaded by a weight 41. As the flexible string 39 is wound onto the member 37, the roll 40 drives a gear 42 via a gear 41' and a sliding contact 43 of a voltage variator 44 for the electrical current supply of the drive 30. The voltage variator 44 can be a rotary transformer as well as a potentiometer. The position of the sliding contact 43 indicated in FIG. 1 corresponds to the highest voltage of the current supplied to the drive motor 30, whereas the position of the sliding contact 43 indicated in FIG. 2 corresponds to the lowest such voltage. The drive motor 30 is a direct-current motor, the rotational speed of which can be continuously varied by varying the voltage of the current supply.

In FIG. 1 the exemplary embodiment of the inventive apparatus is shown shortly after the bobbin change. This is obvious in view of the fact that the bobbin diameter is still very small, approximately corresponding to the diameter of the empty tube 26, that the flyer 19 is in its outermost position $f_A$ at which the fiber sliver reserve $f$ on the drum is maximum, i.e. equals $f_A$, that the cable or string 39 is not wound onto the member 37, and that the sliding contact 43 of the voltage variator 44 is thus in its extreme left-hand position. At this moment the drive motor 30 is supplied with the maximum voltage and its rotational speed is maximum.

In FIG. 2 the same apparatus is shown in FIG. 1, but here it is depicted shortly before the bobbin change. This should be apparent in view of the fact that the bobbin 45 has reached its full diameter, the flyer 19 has reached its innermost position $f_E$ (compare also FIG. 1, broken lines), the fiber sliver reserve $f$ is practically used up, and the cable or string 39 is wound onto the member 37 to such an extent that the sliding contact 43 of the voltage variator 44 upon clockwise rotation is in its extreme right-hand position. The drive motor 30 at this moment is supplied with the minimum voltage and its rotational speed reaches its minimum value. The winding tension of the fiber sliver needed for the winding process is obtained in that the flexible cable or string 39 loaded by the weight 41 exerts a rotational moment upon the member 37 and thus also upon the shaft 18 and upon the flyer 19. Owing to this moment, the magnitude of which depends upon the magnitude of the weight 41 and on the diameter of the member 37, the flyer 19, viewed from the winding device 25, would rotate clockwise. This rotational movement of the flyer 19 however is precluded by the fiber sliver running on the roll 16, i.e. the fiber sliver retains the flyer 19 in its position against the force of the above-mentioned moment, or, in other words, a tensile load acts on the fiber sliver between the drum 3 and the winding device 25. This tensile load forms the required winding tension, the magnitude of which is determined by the diameter of the member 37 if there is employed a given weight 41. The voltage variator 44 is designed such that owing to the voltage supplied to the motor 30 the latter runs at a rotational speed for obtaining the rotational speed or winding speed of the winding spindle 27 with an empty tube when the sliding contact 43 is in the position shown in FIG. 1, whereas the motor 30 runs at a speed needed for obtaining the rotational speed or winding speed with the full diameter of the bobbin 45 when the sliding contact 43 is in the position shown in FIG. 2.

Figure 3:
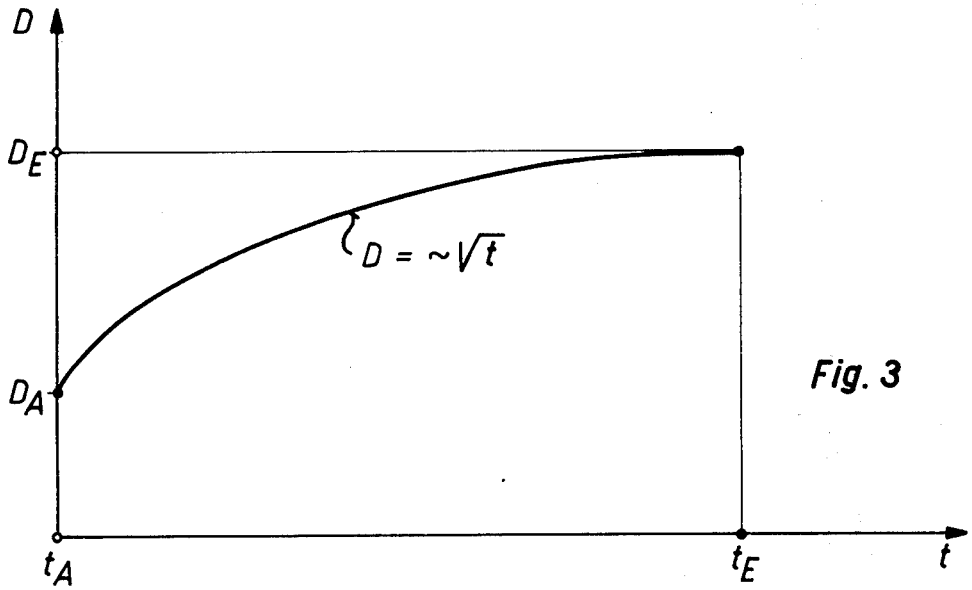
FIG. 3 is a graph depicting the bobbin diameter D plotted as a function of time *t* for a winding device of the type depicted in FIG. 1.
Figure 4:
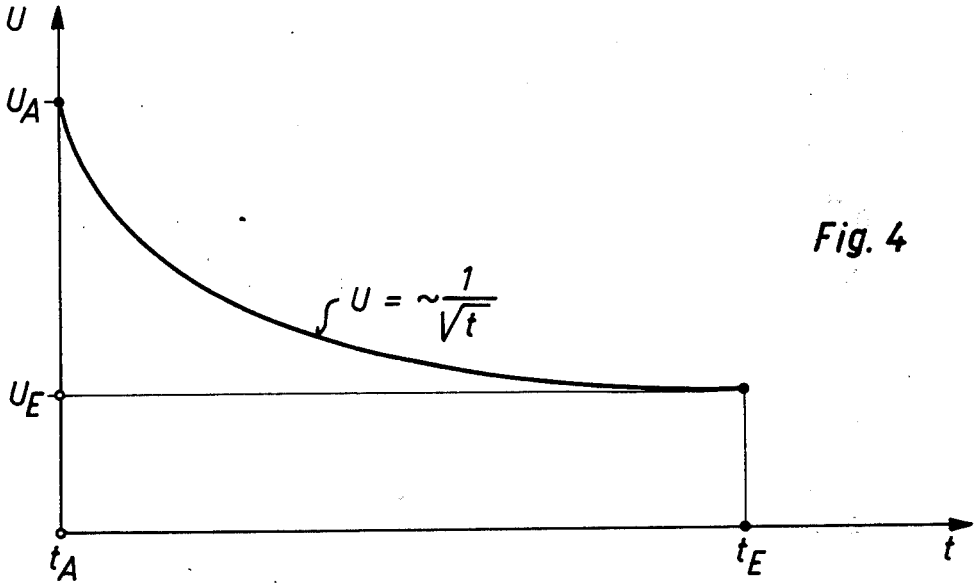
FIG. 4 is a graph illustrating the rotational speed U of the winding device plotted as a function of time *t* for a winding device according to FIG. 1.

In FIG. 3 there is graphically depicted the increase of the bobbin diameter D as a function of time $t$ for which the expression $D = \sim \sqrt{t}$ exists, wherein $D_A$ is the bobbin diameter at the beginning of the winding operation, and $D_E$ is the bobbin diameter at the end of the winding operation. Since the winding spindle 27 is driven in a winding device of the precision winding type, the rotational speed U of the winding device as a function of the time $t$ must follow a curve $U = \sim (1/\sqrt{t}$ which has been shown in FIG. 4. The rotational speed U of the winding device thus must be continuously varied according to a curve of this type between the maximum rotational speed $U_A$ at the beginning of the winding process and the minimum rotational speed $U_E$ at the end of the winding process.

The apparatus according to FIGS. 1 and 2 employing a winding device 25 of the precision winding type functions as follows: Shortly upon the change of a full bobbin which has reached its full diameter, which change is activated by control means not shown, and during which change the winding device 25 was stopped, the apparatus is in the position shown in FIG. 1. The drive motor 30 runs at the highest speed corresponding to the speed needed for winding the fiber sliver onto the empty tube, the supply speed of the fiber sliver being given. The fiber sliver 1 is wound onto the tube 26 and the bobbin diameter increases from $D_A$ to $D_E$ according to the curve $D = \sim \sqrt{t}$ shown in FIG. 3. As the bobbin diameter D increases, the winding speed or the rotational speed U of the winding device, i.e. the rotational speed of the motor is too high and too much fiber sliver is wound onto the bobbin. This excessive length of fiber sliver i.e. the amount exceeding the fiber sliver supply, being wound onto the bobbin 45 is taken by the flyer 19 from the fiber sliver reserve $f$, i.e. the flyer 19 starts at the position $f_A$ reducing the fiber sliver reserve by rotating counterclockwise (as seen from the winding device) and by being screwed in by the fiber sliver 1. Owing to this movement of the flyer 19 the flexible cable or string 39 is also wound onto the member 37 and the sliding contact 43 of the voltage variator 44 is rotated clockwise, which causes the voltage of the current supplied to the drive motor 30 to be reduced so that the rotational speed of the motor 30 is reduced. This control cycle continues as long as the bobbin diameter D continues to increase according to the curve shown in FIG. 3. The flyer 19 thus must continue to take fiber sliver from the reserve $f$, i.e. must continue to screw itself inward, and the motor speed and thus the rotational speed U of the winding device, is automatically adapted according to the curve shown in FIG. 4.

As the bobbin reaches the full diameter $D_E$ (FIG. 2) the flyer 19 is thus in its extreme position $f_E$ shown in FIG. 2, i.e. the entire fiber sliver reserve is reduced or used up respectively. The only condition for this is that at this moment the voltage of the current supplied to the drive motor 30, determined by the position of the sliding contact 43, causes the drive motor 30 to run at a rotational speed, and thus brings about a winding speed, which corresponds to the winding speed needed for winding onto the full bobbin diameter $D_E$. The maximum and minimum voltages of the voltage variator 44 thus must be adapted to the production speed of the installation. The maximum voltage furthermore must be adapted to the empty tube diameter $D_A$ and the minimum voltage must be adapted to the desired full bobbin diameter $D_E$. These voltages at the voltage variator 44 having been correctly chosen the system, flyer-voltage variator-motor, automatically controls itself so that at the end of the bobbin winding phase the entire fiber sliver reserve is used up. As the bobbin reaches its full diameter, the winding device 25 is stopped by any suitable signal device. Then no more fiber sliver is taken-up by the winding device and the flyer immediately starts rotating in the direction of an synchroneously with the drum clockwise (as seen from the winding device). The flyer 19 thus screws itself out of the nut 36. The voltage variator 44 during this process is brought back into its initial position. During the standstill phase the full bobbin is exchanged and replaced by an empty tube. As soon as the fiber sliver reserve $f$ is again fully built up, i.e. as soon as the flyer has again reached the position $f_A$ shown in FIG. 1, the winding device 25 is again started, for instance activated by a suitable signal device. At the beginning the flyer 19 first stands still and subsequently again starts reducing, as described above, the fiber sliver reserve now built up. The whole sequence then is repeated as described above.

In the arrangement shown in FIGS. 1 and 2 the winding tension remains constant during the whole winding phase and also remains constant during the standstill phase as the member 37 is cylindrical and, thus, the moment exerted by the weight 41 upon the flyer remains constant.

Figure 5:
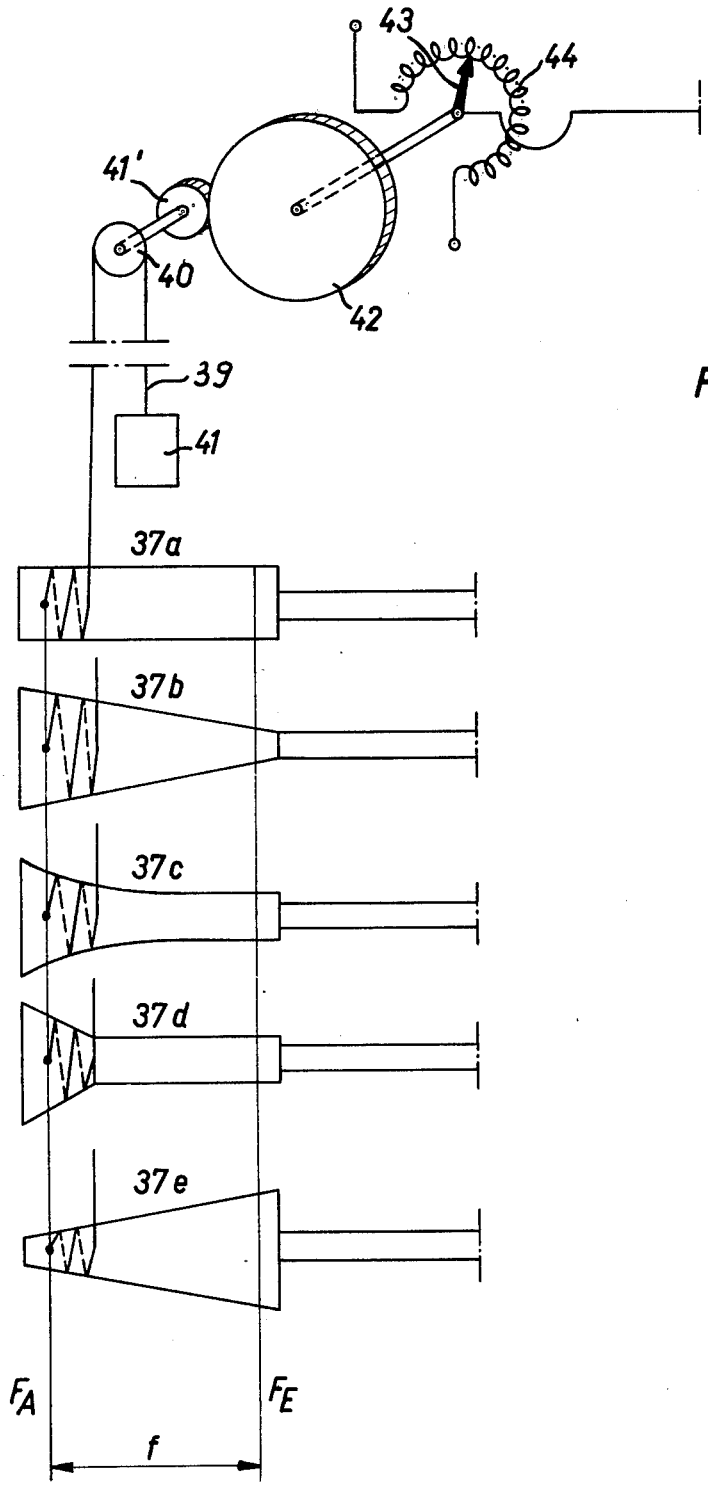
FIG. 5 is a detail of the apparatus according to FIGS. 1 and 2, but depicting further embodiments of the control of the fiber sliver tension.

In FIG. 5 there are shown variants of the member 37. The cylindrical member **37*a*, symmetrical with respect to its axis, again corresponds to the member 37 shown in FIGS. 1 and 2. The other shown member 37*b*** is tapered, its diameter decreasing from the left towards its right side. The further shown member 37*c* is concave, its diameter also decreasing from its left towards its right side. Member 37*d* is tapered in a first section and cylindrical in a second section, as shown, and finally member 37*e* is tapered, its diameter increasing from its left towards its right side. In FIG. 5 the bobbin is wound about half full, i.e. thè bobbin diameter is somewhere between empty and full. This is indicated in FIG. 5 by the median position of he sliding contact 43 of the voltage variator 44 between its two extreme positions.

Figure 6:
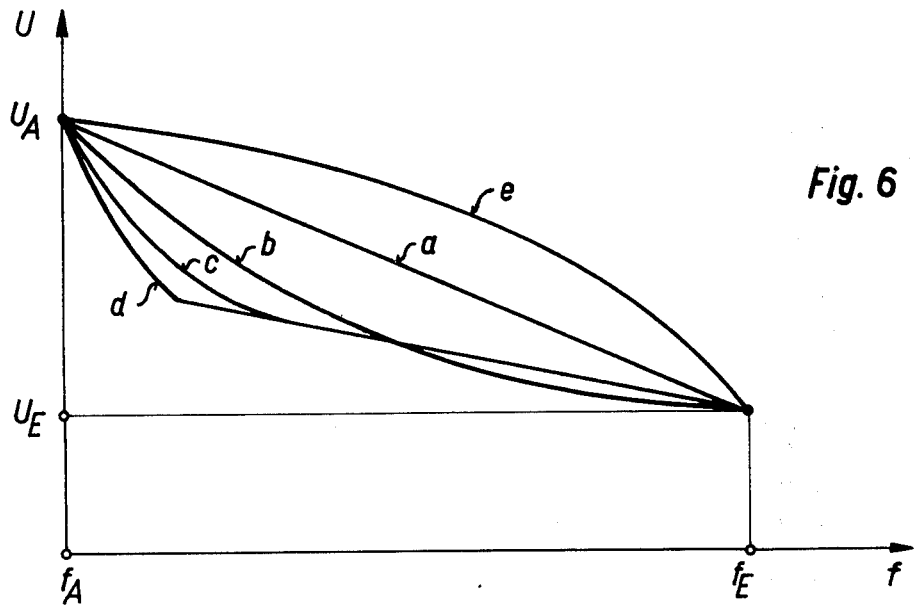
FIG. 6 is a graph showing different curves of the rotational speed U of the winding device plotted as a function of the position *f* of the flyer building-up or reducing respectively the fiber sliver reserve, according to the alternative embodiment of fiber sliver tension control depicted in FIG. 5.

In FIG. 6 the curves *a* – *e* of the rotational speed U of the winding device are plotted as a function of the position of the flyer or the fiber sliver reserve *f* between the positions $f_A$ and $f_E$ for the five different members 37*a* through 37*e*, symmetrical with respect to their respective axis, and as shown in FIG. 5. Only in the case of the cylindrical member 37*a*, shown at the top of FIG. 5, the graph *a* of the rotational speed plotted against the position *f* of the flyer is a straight line. In all other cases a curved or a broken graph is found, the graph *d* corresponding to the member 37*d* being of discontinuous curvature as the surface of member 37*d* is of discontinuous curvature.

Figure 7:
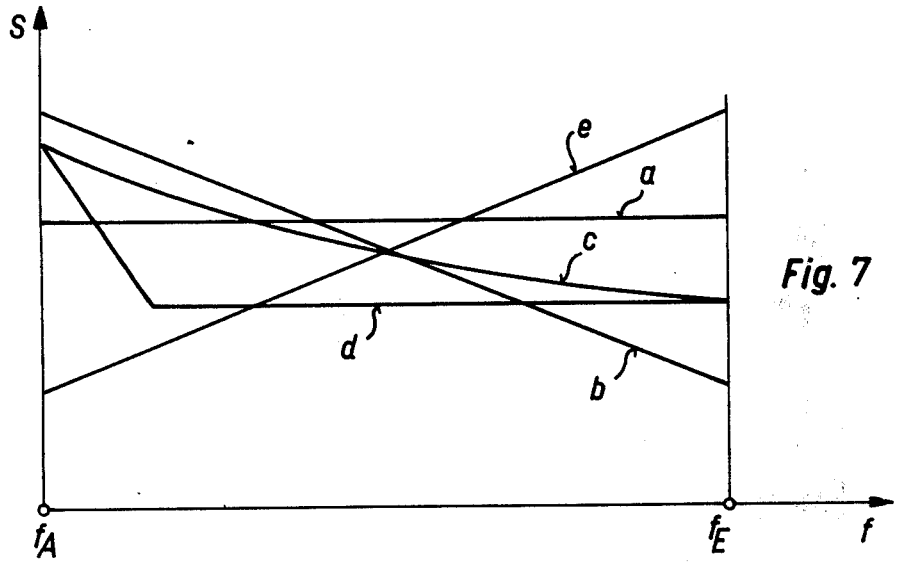
FIG. 7 is a graph showing different curves of the winding tension S plotted as a function of the position of the flyer *f* for the embodiment of fiber sliver tension control shown in FIG. 5.

In FIG. 7 the graphs *a* – *e* represent the winding tension S plotted against the position of the flyer or the fiber sliver reserve *f* between the positions $f_A$ and $f_E$ corresponding to the different members 37*a* through 37*e* shown in FIG. 5. Depending upon the shape of the member symmetrical with respect to its axis different graphs *a* – *e* of the winding tension S are obtained. A cylindrical member 37*a* (FIG. 5) yields a constant winding tension (curve a shown in FIG. 7), a tapered member of the type indicated at 37*b* (FIG. 5) yields a winding tension which at the beginning of the winding proces is higher than at the end of the winding process. The same holds true for the members 37*c* and 37*d*, the latter yielding a graph of the winding tension S which at the beginning of the winding process yields a decreasing characteristic and subsequently (according to the cylindrical section of the member 37*d*) yield a constant characteristic. If the member 37*e* (FIG. 5) is used, a winding tension S is obtained which at the beginning of the winding process is smaller than at the end of the winding process.

The graphic illustrations depicted in FIGS. 5, 6 and 7 show in which manner, according to the scope of the inventive method and apparatus, the winding tension S during the winding phase can be controlled according to a determined function, which can be chosen as desired, namely as a function of the position of the flyer or the fiber sliver reserve *f*, i.e. actually (since a precisely determined bobbin diameter D corresponds to any given position *f*) as a function of the bobbin diameter D. The same function of the winding tension S, but in the inverse sense, also prevails during the standstill phase of the winding device. During this phase, as described above, the flyer is screwed outwards, i.e. the fiber sliver reserve is built-up. The flexible cable or string 39 (FIG. 1) during this phase is unwound from the member 37 (FIG. 1). The fiber sliver 1 remains subject to the influence of the moment generated by the weight 41 (FIG. 1) during this phase, the moment varying during the standstill phase according to the shape of the member 37 determining the function of the moment.

In FIGS. 8 through 15 there is illustrated how in simple manner and electrically the minimum rotational speed of the winding device can be adapted to the variable full diameter of the bobbin.

Figure 8:
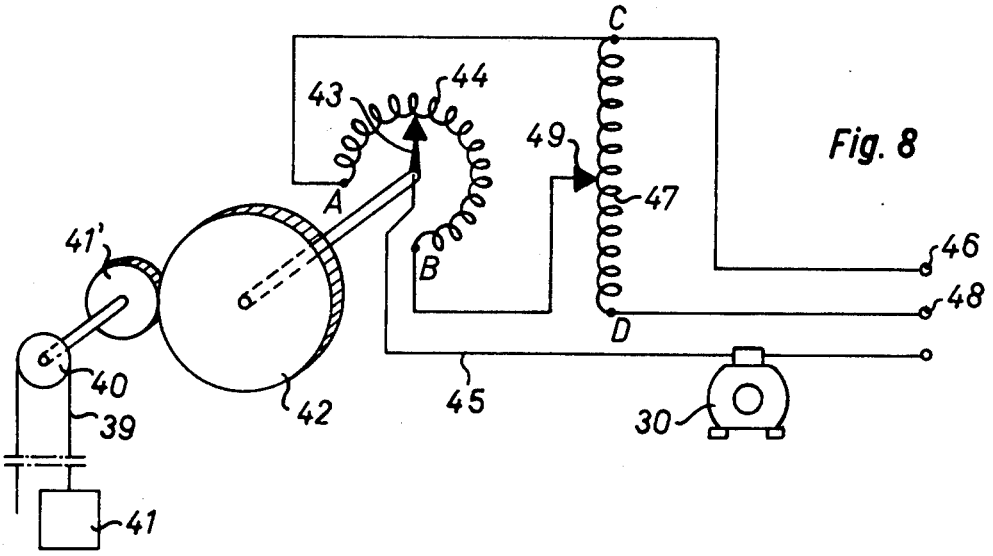
FIG. 8 is an alternative embodiment of control system for the drive motor of the winding device for an apparatus of the type shown in FIGS. 1 and 2, but with two separate tension variators for continuously varying the minimum rotational speed $U_E$ of the winding device.

According to FIG. 8, analogous to the arrangement shown in FIG. 1, a roll 40 is driven by a flexible cable or string 39 with a weight 41. Through the agency of a reduction gear arrangement containing a pair of gears 41′ and 42 the roll 40 drives the sliding cntact 43 of a first rotationally activated voltage variator 44. The sliding contact 43, also here via a conductor 45 just as was shown in the FIGS. 1 and 2, supplies the current for the drive motor 30 of the winding device 25 (FIG. 1). The two terminal or end points A and B of the voltage variator 44 according to FIG. 8, and differing from the arrangement shown in FIGS. 1 and 2, are not directly connected to the power supply source. Between the point A and the connection 46 to the power supply in the arrangement according to FIG. 8 and at the point C there is provided in the circuit a second voltage variator 47, the second end point D of which is directly connected with the power supply connection 48. The end point B of the voltage variator 44 is connected with the sliding contact 43 of the second voltage variator 47.

Figure 9:
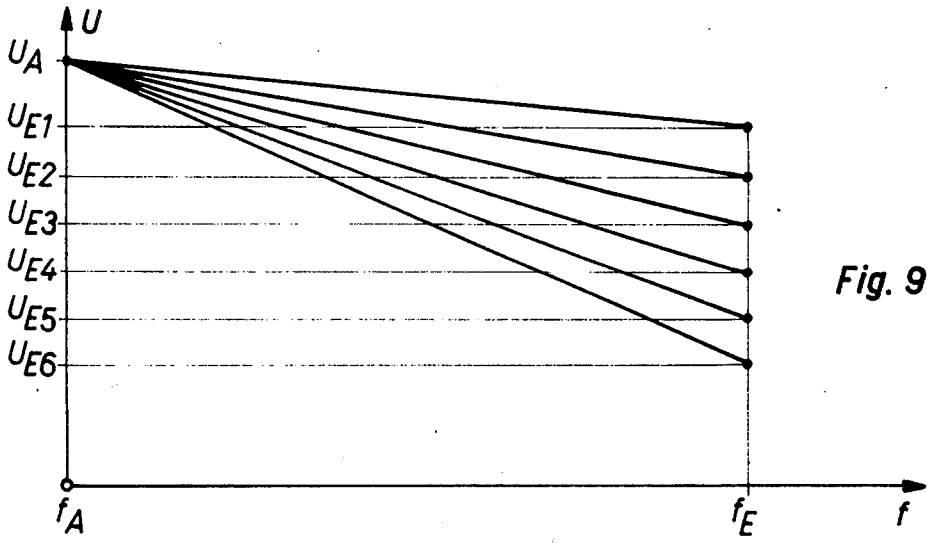
FIG. 9 is a graph showing different curves of the rotational speed U of the winding device plotted as a function of the position *f* of the flyer for the apparatus according to FIG. 8.
Figures 10, 11, 12, 13, 14, 15:
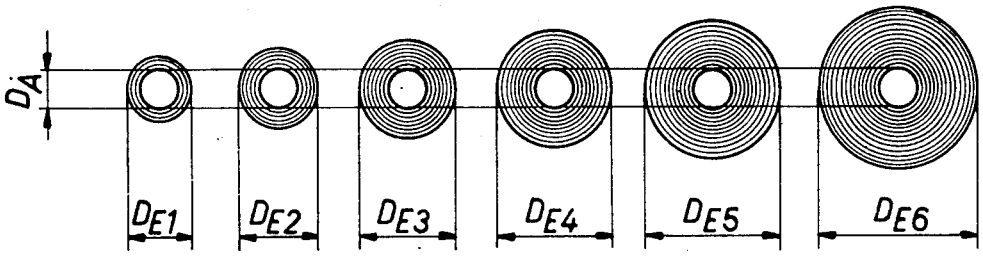
FIGS. 10 to 15 illustrate bobbins, the full diameters $D_E$ of which correspond to the different curves of the rotational speed U of the winding device as a function of the position *f* of the flyer according to FIG. 9.

By means of the arrangement according to FIG. 8 embodying two co-operating voltage variators 44 and 47, the voltage gradient or range in the first voltage variator 44 can be varied. If the sliding contact 49 is positioned at the point D of the second voltage variator 47 the maximum voltage range is obtained between the points A and B of the first voltage variator, i.e. the voltage of the current supplied to the drive motor 30 can be varied between the maximum value which yields the rotational speed $U_A$ of the winding device according to the graph shown in FIG. 9 and a certain minimum value corresponding to the rotational speed $U_{E6}$ according to the graph also shown in FIG. 9. This rotational speed $U_{E6}$ corresponds to the winding speed needed at the end of the winding phase for the maximum desired bobbin diameter of the bobbin. In the examples shown in FIGS. 10 through 15 this rotational speed $U_{E6}$ corresponds to the bobbin of the diameter $D_{E6}$ shown in FIG. 15. If, however, the sliding contact 49 of the second voltage variator 47 is positioned at the point C no more voltage gradient or differential at all is present at the first voltage variator 44, the two points A and B being connected with the same point C of the circuit. In this case the voltge of the current supplied to the drive motor 30 remains constant over the full path of rotation of the sliding contact 43, so that the rotational speed of the winding device also remains constant and equal to the maximum rotational speed $U_A$. Since the rotational speed of the winding device in this last case is not reduced as the flyer 19 is screwed inward, the fiber sliver reserve is thus used up within the shortest possible time. The corresponding full bobbin diameter, according to the shortest duration of the winding phase, is the smallest possible. Between these two extreme positions of the sliding contact 49 all other intermediate positions are possible. By varying the position of the sliding contact 49 of the voltage variator 47, e.g. by hand, it is thus possible, at any given supply speed of the continuously supplied fiber sliver, which of course must be taken into account in choosing the initial rotational speed $U_A$ of the winding device 25 (FIG. 1), to adapt the apparatus according to FIGS. 1 and 2 for production of bobbins of any desired diameter up to a diameter $D_{E6}$. FIG. 9 illustrates for instance six different curves of the rotational speed U of the winding device as a function of the flyer position or the fiber sliver reserve length $f$ and with the associated bobbins. The final rotational speed $U_{E1}$ of the winding device 25 (FIG. 1) corresponds to the bobbin of the full diameter $D_{E1}$ shown in FIG. 10, and so forth.

Figure 16:
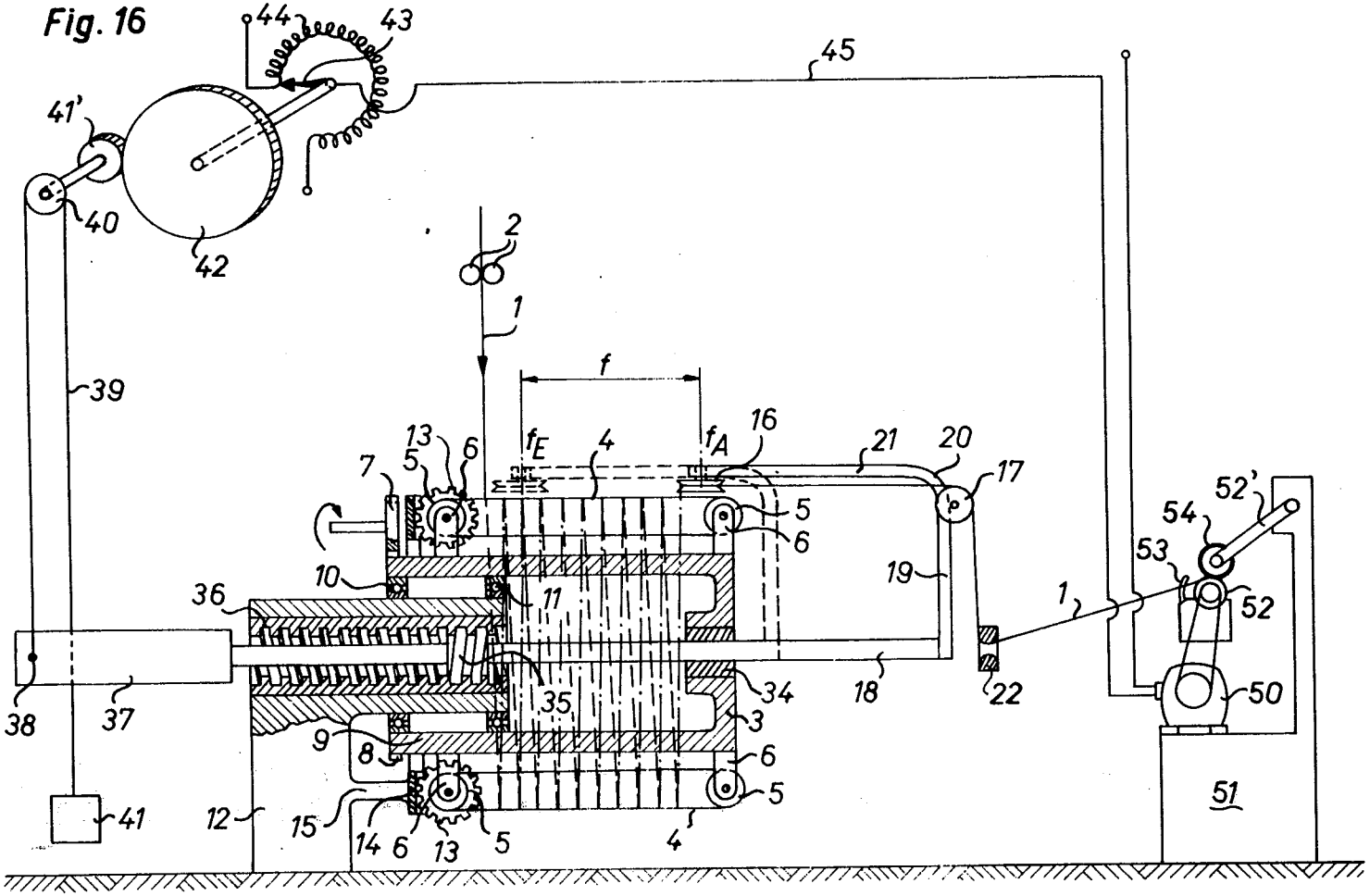
FIG. 16 is a side view and partial section of the inventive apparatus with a friction drive drum, the apparatus being shown shortly after the bobbin change.
Figure 17:
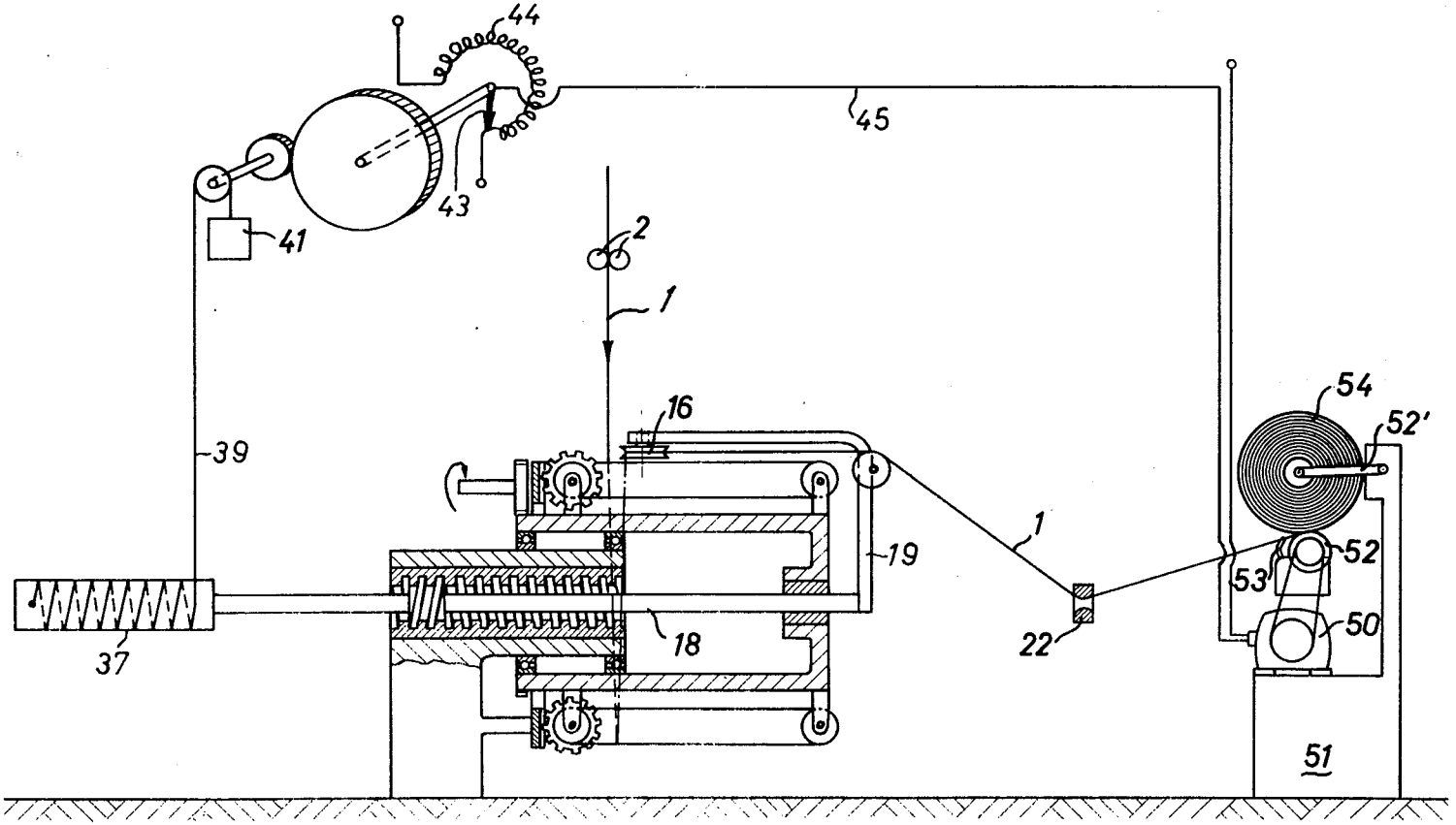
FIG. 17 is the same view of the apparatus depicted in FIG. 16, but shown shortly before the bobbin change.

FIGS. 16 and 17 illustrate the apparatus with a winding device of the friction drive drum type, instead of a winding device of the precision winding type as shown in FIGS. 1 and 2, for winding the continuously supplied fiber sliver. Except for the winding device 51 all other elements of the inventive apparatus according to FIGS. 16 and 17 correspond exactly to the ones shown in FIGS. 1 and 2, so that further description can be dispensed with. The drive motor 50 of this winding device 51 is also controlled in exactly the same manner as shown in and described in conjunction with FIGS. 1 and 2, even if the control characteristic differs entirely from the one mentioned before for precision winding. A winding device 51 of the friction drive drum type substantially consists of a drive motor 50, a friction drive drum 52 driving the bobbin surface by frictional contact, a pivotable usually spring-loaded bobbin arm 52', and a traversing mechanism 53. The drive motor 50 drives in any suitable manner the friction drive drum 52 (e.g. as shown in FIGS. 16 and 17 by means of a belt drive). The traversing mechanism 53 also can be driven by the motor 50 or by a separate motor for achieving its traversing motion. In this type of winding device the friction drive drum 52 must not be necessarily driven in synchronism with the traversing mechanism 53, so that as contemplated by the invention the type of drive used for the traversing mechanism is of no importance. In this arrangement the rotational speed U of the friction drive drum 52 is referred to as the rotational speed of the winding device. The rotational speed U of a winding device of this type, i.e. the rotational speed of the drive motor 50, in principle need not be varied as a function of the bobbin diameter, since owing to the friction drive the winding speed is independent of the bobbin diameter. As, however, in a winding device of this type the friction conditions between the friction drum 52 and the bobbin 54 vary during the winding phase, depending upon the bobbin diameter, the material being processed, the load characteristics of the bobbin support arm 52', and so forth, in this arrangement a control of the rotational speed of the winding device must be also provided. The apparatus here proposed permits, in a very simple manner, solution of this problem and also the problem of creating a standstill phase of the winding device, during which the full bobbin can be simply changed.

Figure 18:
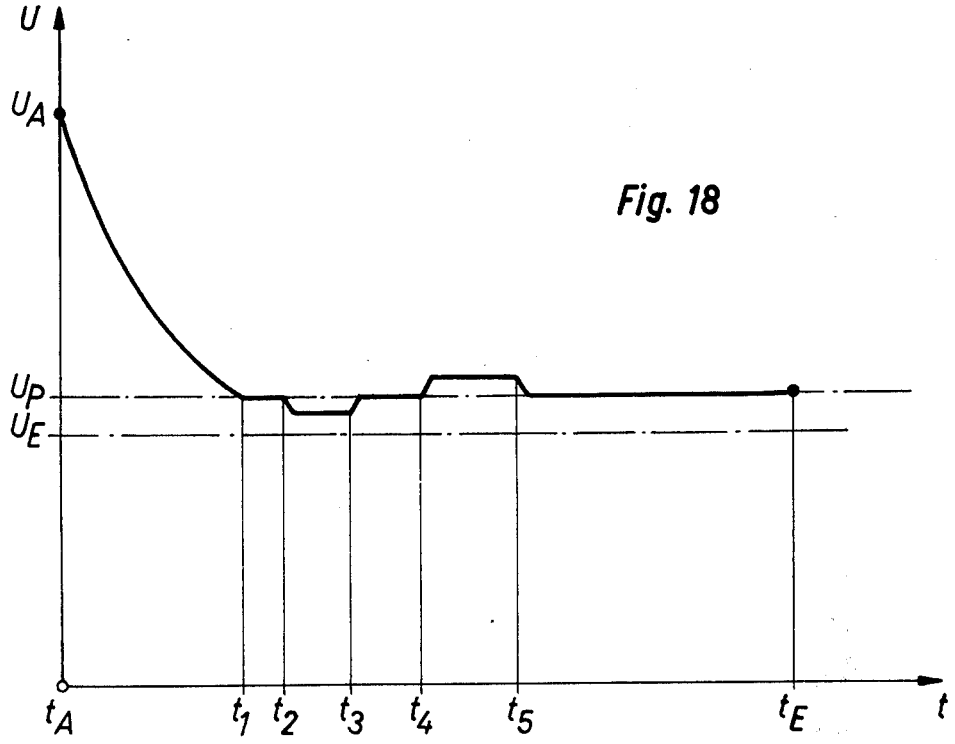
FIG. 18 is a graph showing the rotational speed U of the winding device plotted as a function of the time *t* for the apparatus according to FIGS. 16 and 17.
Figure 19:
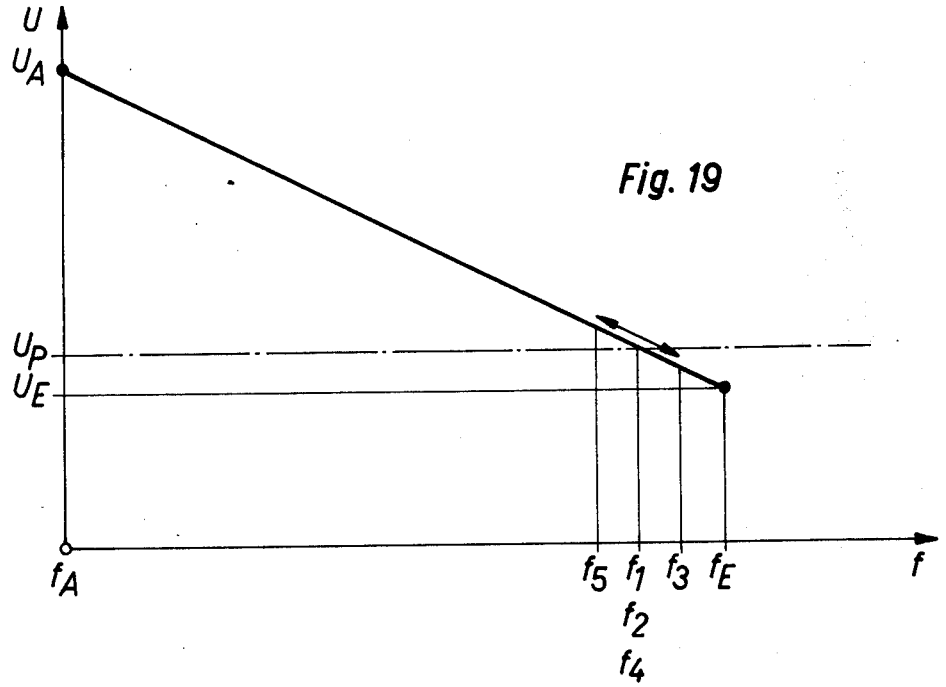
FIG. 19 is a graph showing the rotational speed of the winding device plotted as a function of the position *f* of the flyer building and reducing respectively the fiber sliver reserve in an apparatus according to FIGS. 16 and 17.

In FIG. 16 the apparatus is shown shortly after the bobbin change, in FIG. 17 shortly before the next bobbin change, in FIG. 18 the rotational speed U of the winding device is plotted against time $t$, and in FIG. 19 the rotational speed U is shown plotted against the position of the flyer or of the fiber sliver reserve $f$.

In the apparatus shown in FIGS. 16 and 17 the initial voltage and the final voltage of the voltage variator 44, i.e. the voltage corresponding to the two extreme positions of the sliding contact 43 according to FIGS. 16 and 17 are chosen such that, as shown in FIG. 19, the initial rotational speed $U_A$ of the winding device 51 (corresponding to the position of the sliding contact 43 shown in FIG. 16) substantially exceeds the supply rotational speed $U_p$ of the winding device 51. The supply rotational speed $U_p$ is the rotational speed at which the surface speed of the friction drive drum 52 exactly corresponds to the supply speed of the fiber sliver. At this rotational speed $U_p$, provided that there is no slippage between the bobbin 54 and the friction drum 52, exactly as much fiber sliver is thus wound onto the bobbin 54 as is supplied within the same unit of time. The final rotational speed $U_E$ of the winding device, i.e. the rotational speed of the apparatus at the moment when the sliding contact 43 has reached its extreme right-hand position (FIG. 17), is chosen somewhat below the supply rotational speed $U_p$ as shown in FIG. 19. The difference between $U_p$ and $U_E$ must be just sufficient so that possible variations of friction properties between the friction drive drum 52 and the bobbin 54 can be levelled out by corresponding adaption of the rotational speed U. Such variations of friction properties according to experience range within ± 5 percent of the supply speed, which is a small range. The fiber sliver 1 upon passing through exactly the same elements as shown in FIGS. 1 and 2 is transferred, according to FIGS. 16 and 17, through the eyelet or guide 22 and from there directly passes to the traversing mechanism 53 of the winding device 51.

The apparatus depicted in FIGS. 16 and 17 with a winding device of the friction drive drum function as follows: Shortly after the bobbin change (FIG. 16) the flyer 19 is located in the position indicated with solid lines. Onto the member 37 there is still not wound the flexible cable or string 39 and the sliding contact 43 of the voltage variator 44 is located at its left-hand stop. The winding device 51 is driven at the rotational speed $U_A$. $U_A$ being higher than $U_p$ more fiber sliver 1 is wound onto the bobbin than is supplied. The flyer 19 thus, just as in the arrangement described with reference to FIGS. 1 and 2, must take fiber sliver from the rotating storage drum 3, i.e. the flyer must screw itself into the threaded portion or nut 36 under the influence of the pull of the fiber sliver. In this process the flexible cable or string 39 is wound onto the member 37 and the sliding contact 43 of the voltage variator 44 is progresively rotated in the direction of lower voltages. The rotational speed U of the winding device 51 as a function of the time $t$ is reduced according to the graph shown in FIG. 18. The rotational speed U as a function of the position of the flyer or of the fiber sliver reserve $f$ is reduced according to the graph shown in FIG. 19. The flyer 19 takes fiber sliver from the fiber sliver reserve $f$ until the rotational speed U of the winding device 51 corresponds to the rotational speed $U_p$. Since at this moment the winding speed and the supply speed are equal, the flyer 19 no longer takes fiber sliver from the reserve. The flyer 19 no longer rotates, so that the rotational speed of the motor and thus the rotational speed U of the winding device no longer is adjusted. This is the case at the time $t_1$ according to FIG. 18, or at the position $f_1$ of the flyer according to FIG. 19. If from now on the winding speed remains equal to the constant supply speed, the rotational speed U of the winding device 51 will remain equal to $U_p$. If, however, at a time $t_2$ (FIG. 18) the slippage between the friction drive durm 52 and the bobbin 54 becomes smaller, the winding speed immediately becomes higher than the supply speed. The flyer thus again takes more fiber sliver from the fiber sliver reserve and reaches e.g. the position $f_3$ (FIG. 19) and remains in this position until the friction conditions cease their variation. If at the time $t_3$ (FIG. 18) the slippage e.g. increases again, the rotational speed U then must increase, as otherwise the flyer would not take enough fiber sliver from the drum surface, and the fiber sliver reserve $f$ would increase.

The flyer 19 thus is screwed outwards somewhat i.e. the flyer 19 e.g. returns to the position $f_1$, so that the winding speed is correct again.

As shown in FIGS. 18 and 19, beginning from the time $t_1$ the flyer will vary its position around the position $f_1$ according to the increase or decrease of the friction between the friction drum 52 and the bobbin 54. The rotational speed U of the winding device also varies accordingly without ever reaching a lowest rotational speed $U_E$ which in view of the friction condition was freely chosen as desired. The slope of the curve of U as a function of $f$ is chosen so steep that the difference in friction (max. ± 5 percent) can be taken care of within a limited range of the flyer position $f$ (e.g. between $f_5$ and $f_3$ according to FIG. 19).

If now the bobbin 54 has reached its full diameter after a time $t_E$ of any duration (FIG. 17), then the winding device 51 is stopped by a suitable signal. The flyer 19 which must be located in the range $f_5$ to $f_3$ according to FIG. 19, immediately starts screwing itself outwardly, i.e. the fiber sliver reserve is built up. Since the range $f_5$ to $f_3$ is small compared to the range $f_A$ to $f_5$ a sufficiently long time-span is available fo the bobbin change. As the flyer 19 reaches its initial position $f_A$, i.e. as the fiber sliver reserve is again fully built-up, the winding device 51 is again started through activation by a suitable signal, and after the full bobbin has been automatically or manually exchanged for an empty tube during the standstill phase.

In this arrangement the winding tension generated by the moment acting on the flyer 19 also prevails. In the case described with reference to FIGS. 16 and 17 the winding tension is maintained constant throughout the whole winding phase and also throughout the standstill phase, the member 37 being chosen to be of cylindrical construction. If other shapes of the member 37 are used, the winding tension, at least during the time span $t_A$ to $t_1$ (FIG. 18), can be controlled according to any other desired function.

The advantages of the inventive method and apparatus described with reference to FIGS. 1 and 2, as well as with regard to FIGS. 16 and 17, resides in the features that it is possible in very simple manner to control the winding tension and the rotational speed of a simple winding device taking-up a continuously supplied fiber sliver, on which the bobbin can be changed while the winding process is at a standstill. The method aspects and the apparatus structure are suitable if there are used winding devices of the precision winding type or of the friction drive drum type.

Figure 20:
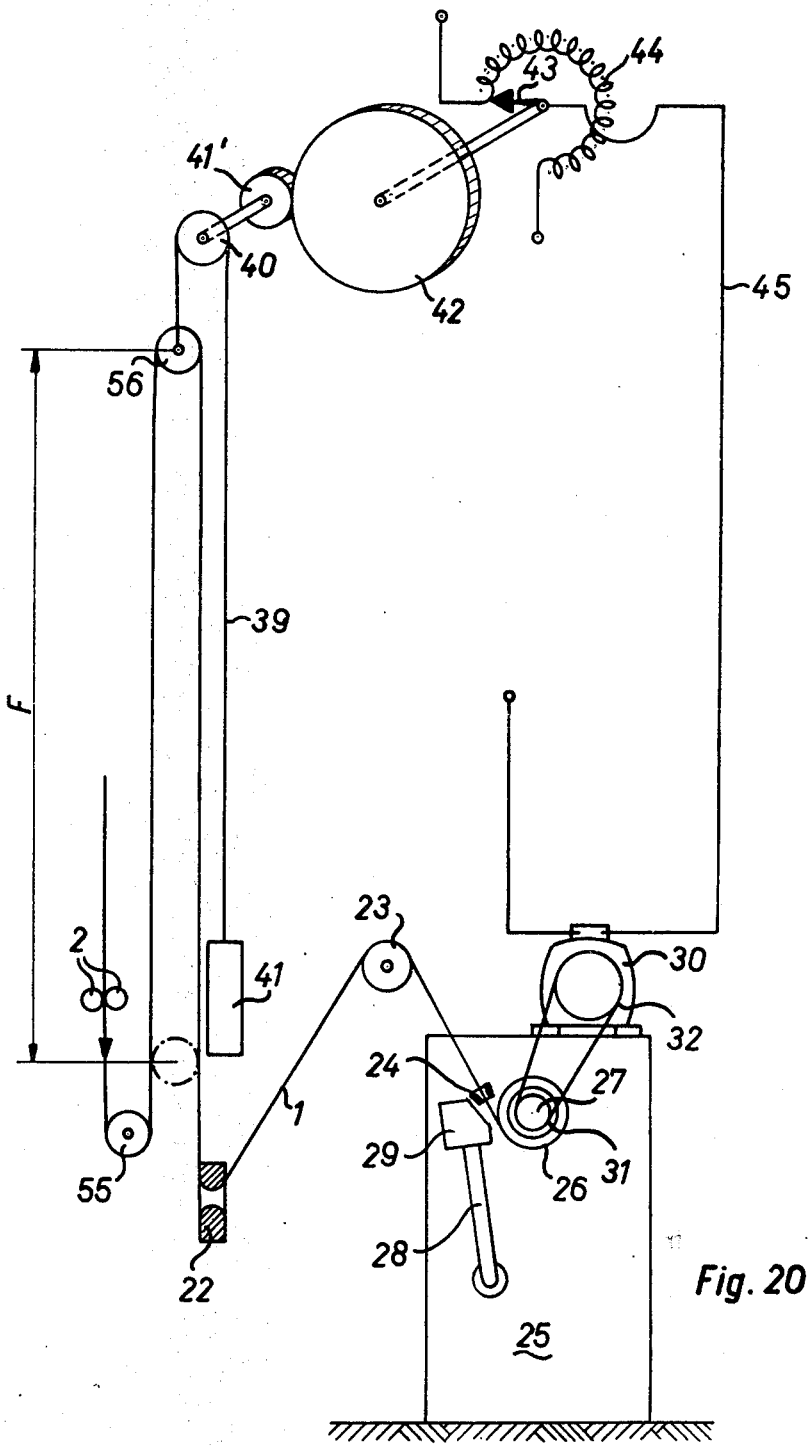
FIG. 20 is a further embodiment of the apparatus, shown in schematic view, shortly after the bobbin change.

In the embodiments described with reference to FIGS. 1 and 2 and FIGS. 16 and 17, wherein as a support of the fiber sliver reserve there is used a storage drum 3, there is obtained the advantage that since the storage capacity of a storage drum 3 of this type is very large (e.g. 100 meters of fiber sliver can be stored), very long time-spans are available for changing the bobbin. Thus, the bobbin change operation is more reliable. The duration of the standstill phase is preferably chosen longer than 10 seconds. i.e. the storage capacity of fiber sliver reserve take-up should be sufficient to take-up the fiber sliver supplied during 10 seconds. The fiber sliver reserve, however, also can be built-up or reduced in another manner. Thus for example, in FIG. 20 an alternative embodiment of the apparatus according to FIGS. 1 and 2 is schematically shown, in which a winding device of the precision winding type identical to the one indicated by reference character 25 shown in FIGS. 1 and 2 is provided and which is also equipped with a flexible cable or string 39 loaded by a weight 41 which via a roll 40 and gears 41' and 42 activates the sliding contact 43 of the voltage variator 44. In this arrangement the voltage variator also supplies the drive motor 30 of the winding device 25 with current of variable voltage. The identical elements shown in both FIGS. 1 and 20 are designated by the same reference numerals. The arrangement shown in FIG. 20 differs from the one shown in FIG. 1 in that the apparatus according to FIG. 20 differs from the one shown in FIG. 1 in that in the arrangement of FIG. 20 no rotating storage drum is provided, merely a dancer-type roll 56 moving along a path F and which builds-up and reduces the fiber sliver reserve between a rotating roll 55 arranged stationary with respect to the room and a guide eyelet 22 also arranged stationary with respect to the room. The roll 56 is pulled upward against the pull of the sliver 1 by the flexible cable 39. Thus, also in this arrangement, the winding tension is generated by the weight 41. Control of the drive motor 30, i.e. of the winding device 25 is effected in the apparatus according to FIG. 20 exactly in the same manner as in the apparatus according to FIGS. 1 and 2, the position of the weight 41 and the flexible cable 39 being determined in both cases directly by the fiber sliver reserve (length $f$ in FIGS. 1 and 2, and length F in FIG. 20).

Figure 21:
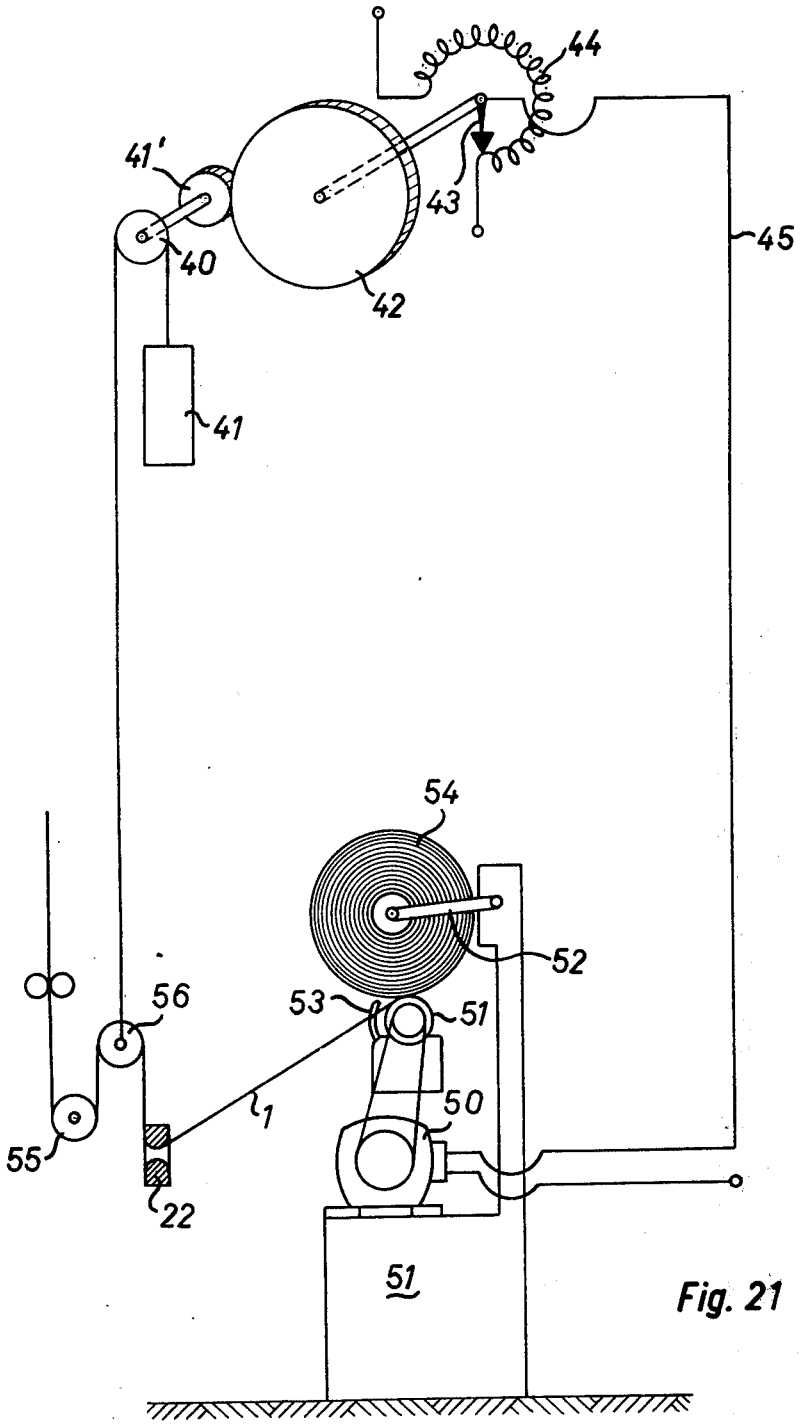
FIG. 21 is an alternative embodiment of the apparatus, depicted in schematic view, shortly before the bobbin change operation.

The same apparatus as shown in FIG. 20, used with a winding device 51 of the friction drive drum type identical to the one shown in FIGS. 16 and 17 for winding the continuously supplied fiber sliver 1, is schematically shown in FIG. 21. In FIG. 21 the apparatus is shown (similar to the one shown in FIG. 17) shortly before bobbin change. The drive motor 50 of the winding device 51 is controlled by identical means as shown in FIG. 20.

The alternative embodiments according to the showing of FIGS. 20 and 21 are more simple in design compared to the embodiments depicted in FIGS. 1 and 2 or FIGS. 16 and 17 respectively. The function of the apparatus according to FIGS. 20 and 21 respectively, in principle is the same as described for the apparatus according to FIGS. 1 and 2 or 16 and 17 respectively. The difference merely consists in that when using the apparatus constructions according to FIGS. 20 and 21 respectively, only short time periods are available (according to the smaller storage capacity of the storage element for the fiber sliver) for the standstill phase of the winding device during which bobbin change is effected, and that the winding tension during the winding phase an during the standstill phase only can be maintained constantly. Thus, if the bobbin change can be effected within a relatively short time-span and if the winding tension can be maintained constant during the entire winding phase and the standstill phase without disadvantages, the use of an apparatus according to the embodiment shown in FIGS. 20 and 21 is feasible. In all other cases the apparatus according to FIGS. 1 and 2 or FIGS. 16 and 17 respectively can be used.

While there is shown and described present preferred embodiments of the invention, it is to be distinctly understood that the invention is not limited thereto but may be otherwise variously embodied and practiced within the scope of the following claims. ACCORDINGLY,

What is claimed is:

1. Apparatus for controlling the winding of a continuously supplied fiber sliver on a bobbin comprising:

a. a winding device for winding said continuously supplied fiber sliver from a supplying device on the bobbin arranged on said winding device;

b. means for interrupting the winding phase of the winding device by a standstill phase during a bobbin change;

c. a storage drum including guiding means for building-up a fiber sliver reserve, said drum being arranged in the path of said fiber sliver between said supplying device and said winding device for receiving the fiber sliver supplied with a continuous speed to said storage drum, said drum having a surface on which the fiber sliver is helically wound, and means for transporting the helically wound fiber sliver at the surface of the drum in the longitudinal direction of such drum;

d. said guiding means being arranged downstream of said storage drum between the supplying device and the winding device, said guiding means being arranged at least translatorily movably over a distance of the drum surface for building-up the fiber sliver reserve thereon during the standstill phase and for reducing the fiber sliver reserve during the winding phase, said guiding means being operatively connected with means for moving the guiding means to build-up the fiber sliver reserve and for maintaining constant the tension of the fiber sliver during the winding and the standstill phase; and e. means for electrically controlling a drive motor of the winding device, said means for electrically controlling the drive motor being connected with said guiding means and said winding device, said means for electrically controlling the drive motor being arranged to be operated by movement of said guiding means.

2. The apparatus as defined in claim 1, wherein said storage drum is of a rotating drum type.

3. The apparatus according to claim 1, wherein said guiding means is arraged on an arm of a flyer mounted to be coaxially rotatable with regard to the longitudinal axis of the drum, a threaded member for rotatably supporting the flyer, said flyer during rotation moving longitudinally with the same pitch as the helix of the fiber sliver wound onto the surface of the drum 4. The apparatus as defined in claim 1, wherein said means for electrically controlling the drive motor of the winding device comprise a stationary roll influencing the voltage of the drive motor, and wherein said means for moving said guiding means and for tensioning the fiber sliver comprise a flexible weight-loaded cable-which is guided at said stationary roll, and a rotatable member substantially symmetrical with respect to its axis of rotation for winding and unwinding said cable thereon, said rotatable member having a substantially cylindrical surface, said cable exerting a moment upon said member.

5. The apparatus according to claim 1, wherein said means for electrically controlling the drive motor of the winding device comprise a voltage regulator influencing the voltage of the drive motor, said means for moving the guiding means and for maintaining constant the tension of the fiber sliver comprise a flexible weight-loaded cable and a rotatable member substantially symmetrical with respect to its axis of rotation for winding and unwinding said cable thereon, said member being directly connected with said volage regulator, said member having a substantially cylindrical surface, said cable exerting a moment upon said member.

6. The apparatus as defined in claim 4, wherein the drive motor of the winding device is connected with a voltage regulator for controlling the rotational speed of said drive motor, said regulator comprising a sliding contact influencing the voltage of the drive motor, said contact being connected via a gear with said sationary rotatable roll and being movable between two positions for continuously varying the rotational speed of the drive motor between a maximum and a minimum speed.

7. The apparatus as defined in claim 6, wherein said voltage regulator is connected with a further voltage regulator for adjusting the minimum rotational speed of the drive motor dependent of a chosen end diameter of the bobbin.

8. The apparatus as defined in claim 1, wherein the winding device is of the precision winding type in which a bobbin support axle is driven by a DC motor.

9. The apparatus as defined in claim 1, wherein the winding device is of a friction drive drum type in which a bobbin is driven at its surface frictionally.

* * * * *